United States Patent [19]

Shinohara et al.

[11] Patent Number: 4,965,608

[45] Date of Patent: Oct. 23, 1990

[54] DRIVING METHOD FOR INK JET HEAD

[75] Inventors: Hayato Shinohara, Yokohama; Isao Tsukada, Kawasaki, both of Japan

[73] Assignee: Canon Kabushiki Kaisha, Tokyo, Japan

[21] Appl. No.: 190,170

[22] Filed: May 4, 1988

[30] Foreign Application Priority Data

May 11, 1987 [JP] Japan ..... 62-115255

[51] Int. Cl.[5] ..... B41J 2/05

[52] U.S. Cl. ..... 346/1.1; 346/140 R

[58] Field of Search ..... 346/1.1, 140

[56] References Cited

U.S. PATENT DOCUMENTS 4,323,908 4/1982 Lee ..... 346/140

4,466,005 8/1984 Yoshimura ..... 346/140

4,500,895 2/1985 Buck ..... 346/140

4,558,332 12/1985 Takahashi ..... 346/140 R 4,712,172 12/1987 Kiyohara et al. ..... 346/1.1

4,723,129 2/1988 Endo ..... 346/140

*Primary Examiner*—Joseph W. Hartary

*Attorney, Agent, or Firm*—Fitzpatrick, Cella, Harper & Scinto

[57] ABSTRACT

A driving method for an ink jet recording head, causes liquid emission not intended for recording by energizing driving elements provided respectively corresponding to plural nozzles and provided for generating energy for liquid emission. The driving elements are energized in succession starting from the driving element corresponding to the upper-most nozzle toward the one corresponding to the lower-most nozzle.

15 Claims, 7 Drawing Sheets

DRIVING METHOD FOR INK JET HEAD

BACKGROUND OF THE INVENTION

1. Field of the Invention

The present invention relates to a driving method for an ink jet recording head, and more particularly to such a driving method adapted for preventing or resolving the clogging of an ink jet recording head.

2 Related Background Art

In ink jet printers, in order to prevent or resolve the nozzle clogging caused by evaporation of a solvent component such as water from the ink in said nozzle, there has been employed blank ink emission, not intended for printing, before the start of printing operation either after the start of power supply or after a predetermined pause without a printing operation. Such blank ink emission has been conducted by simultaneously energizing all of the driving elements corresponding to plural nozzles the same number of times.

However, plural nozzles tend to show different level of clogging due to the head structure or the ink characteristics. For example, if plural nozzles are arranged along a vertical line, the clogging tends to appear in the lower nozzles. This phenomenon is presumably attributable to the fact that the water evaporates from the ink in different nozzles, and denser ink tends to gather in lower positions.

For this reason the number of ink emissions has been determined to be the number required for restoring the lower nozzles that tend to clog most frequently, and all the driving elements corresponding to the plural nozzles have been simultaneously energized that many times. This operation has the following latent drawbacks:

(1) There is useless consumption of ink, since the driving elements corresponding to the upper nozzles, showing less frequent clogging, are energized in synchronization with those of the lower nozzles; and (2) In energizing the driving elements of the lower nozzles, which have been clogged and are therefore incapable of emitting the ink, particularly in the bubble jet system utilizing thermal energy, there may remain bubbles generated by the liberation of gas dissolved in the ink, caused by the thermal energy accumulated therein, thus leading to new nozzle clogging.

SUMMARY OF THE INVENTION

In consideration of the foregoing, an object of the present invention is to provide a driving method for an ink jet recording head, capable of resolving or preventing defective ink emission or nozzle clogging without unnecessary ink consumption.

Another object of the present invention is to provide a driving method for an ink jet recording head, capable of securer and satisfactory resolution or prevention of defective ink emission or nozzle clogging.

Still another object of the present invention is to provide a driving method for an ink jet recording head, capable of suppressing the liberation of dissolved gas from the ink by the accumulation of thermal energy imparted thereto, often encountered in an ink jet recording method utilizing thermal energy for ink emission (for example bubble jet recording), and effectively resolving or preventing defective ink emission or nozzle clogging.

Still another object of the present invention is to provide a driving method for an ink jet recording head, capable of resolving or preventing defective ink emission or nozzle clogging, often encountered in lower nozzles of a nozzle array having a vertical component.

Still another object of the present invention is to provide a driving method for ink jet recording head in which driving elements provided respectively corresponding to plural nozzles, for generating energy for causing liquid emission from said nozzles, are energized to cause liquid emission not intended for recording, said method being featured by energizing the driving elements in succession from those corresponding to the upper nozzles to those corresponding to the lower ones.

DETAILED DESCRIPTION OF THE PREFERRED EMBODIMENTS

The foregoing objects can be achieved by a driving method of an ink jet recording head in which driving elements provided respectively corresponding to plural nozzles, for generating energy for causing liquid emission from said nozzles, are energized to cause liquid emission not intended for recording, wherein said driving elements are energized in succession from those corresponding to the upper nozzles toward those corresponding to the lower ones.

More specifically, according to the present invention, the driving elements provided respectively corresponding to plural nozzles arranged in a vertical array are energized in succession from the one corresponding to the uppermost nozzle to the one corresponding to the lowermost nozzle, with a gradually increased amount of energization toward the one corresponding to the lowermost nozzle, and the energization is terminated in succession from the one corresponding to the uppermost one, thereby preventing excessive ink emission, also preventing bubble generation from dissolved gas often experienced in the lower part of the head and securing emission of ink of higher viscosity which is present more in the lower part of the head.

In addition the successive energization from the upper part of the head induces an ink flow in the recording head, thus causing intermixing of the ink between the upper and lower parts of the head and reducing the viscosity of the ink in the lower part, thereby maximizing the effect of the ink emission.

In the following the driving method for ink jet recording head of the present invention will be clarified in detail by embodiments thereof shown in the attached drawings.

Figure 1A:
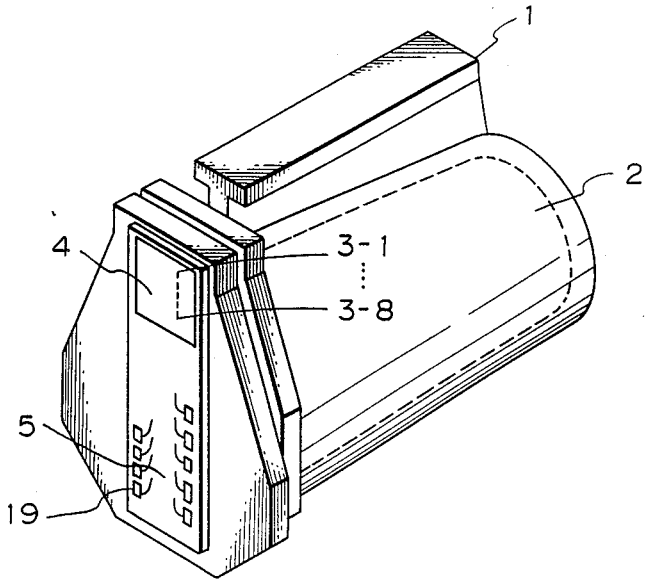
FIG. 1A is a schematic perspective view of a disposable ink cartridge to be employed in the present invention.
Figure 1B:
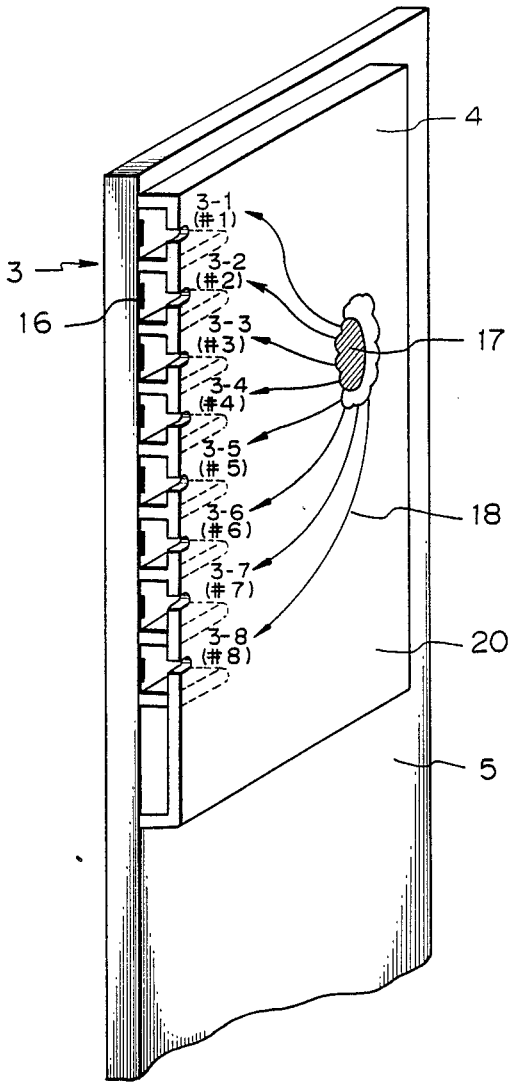
FIG. 1B is a schematic vertical cross-sectional view of a recording head.

FIG. 1A is a schematic perspective view of a disposable ink jet head cartridge to be employed in the present invention; and FIG. 1B is a schematic vertical cross-sectional view of a recording head 3. In these drawings there are shown an ink bag 2; nozzles 3-1 - 3-8 for ink emission; a nozzle plate 4 composed of a metal plate constituting an ink emission unit containing nozzles; and a glass substrate 5 provided thereon with heat generating members 16 and electrode patterns 19 constituting driving elements for generating thermal energy for liquid emission and further provided with an ink supply hole 17 for ink supply from said ink bag. Arrows 18 indicate the ink flow from the ink supply hole 17 to each nozzle. FIG. 1B illustrates that the ink is supplied from the supply hole 17 to the driving elements through a common liquid chamber communicating to the nozzles.

Figure 2:
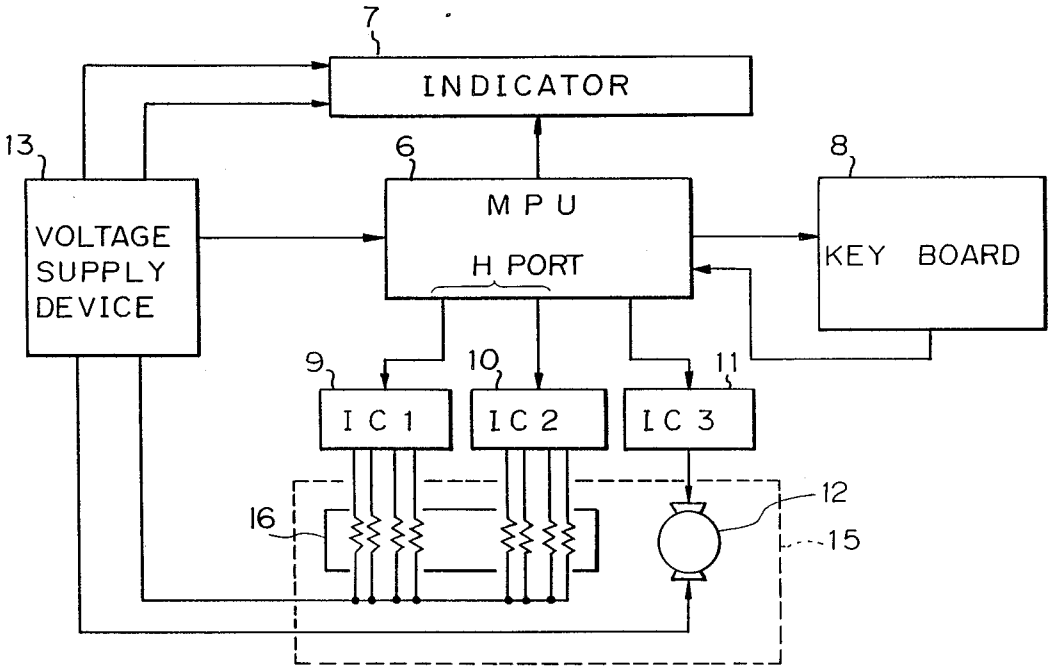
FIG. 2 is a block diagram of the electric circuit of an electronic calculator with a printer employing the cartridge shown in FIG. 1.
Figure 3A:
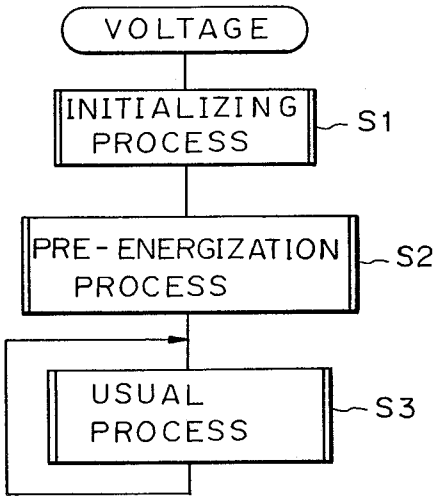
FIGS. 3A, 3B, 3C and 3D are flow charts of a preliminary energizing procedure after the start of power supply or after the absence of a printing operation for a predetermined period.
Figure 3B:
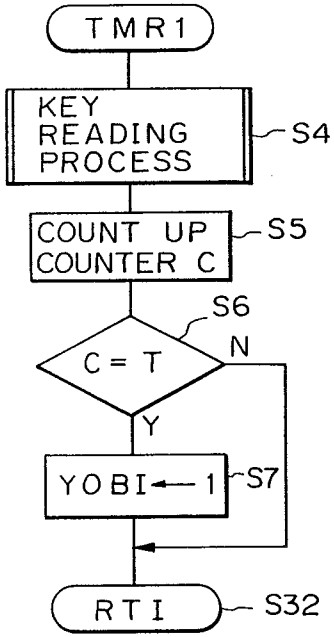
Figure 3C:
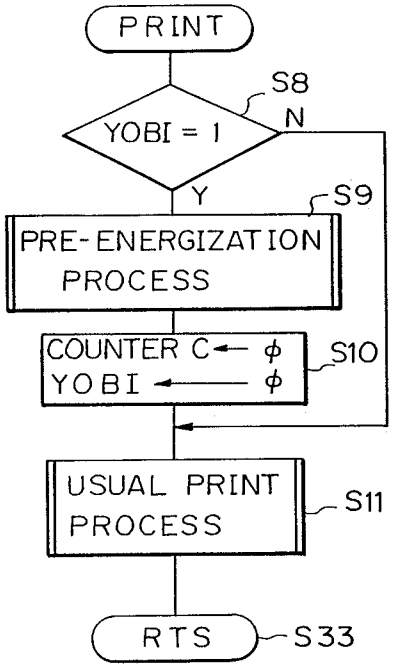
Figure 3D:
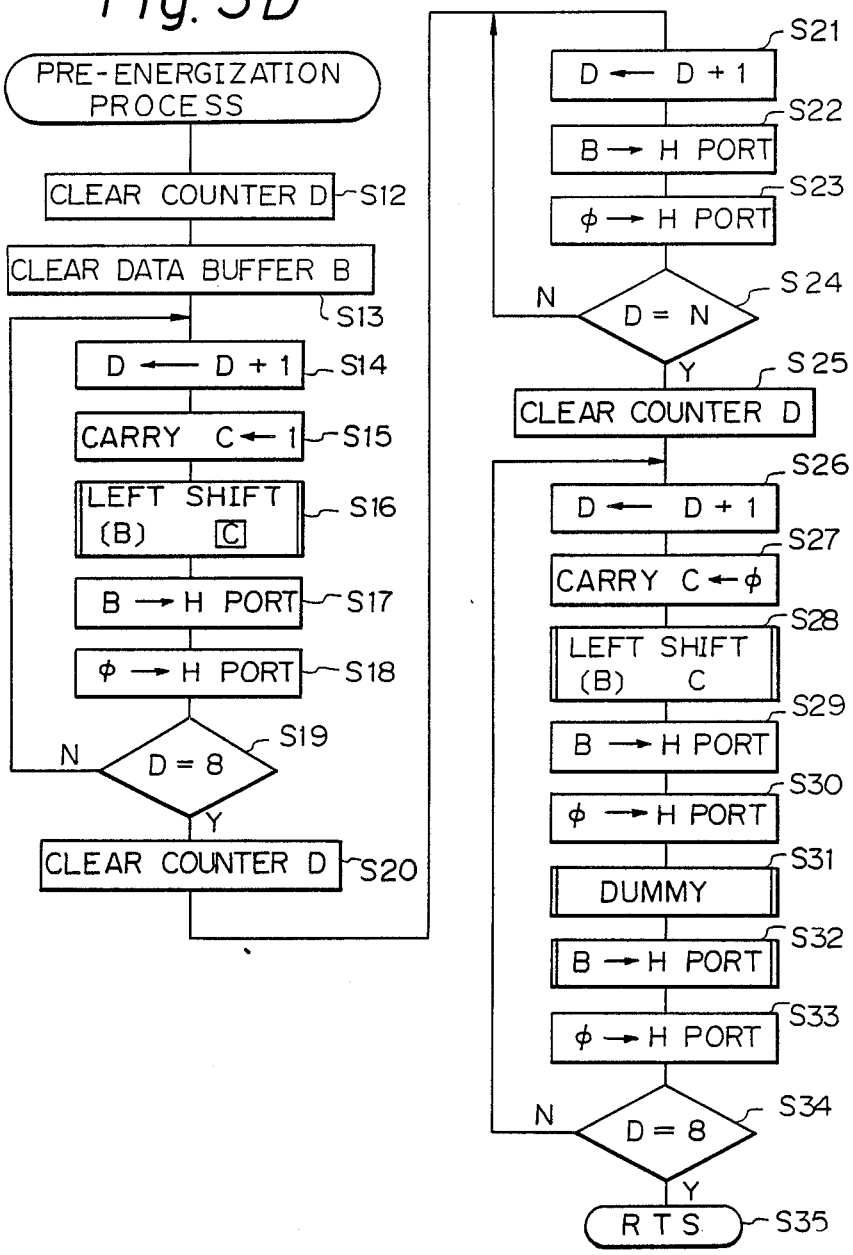
Figure 4:
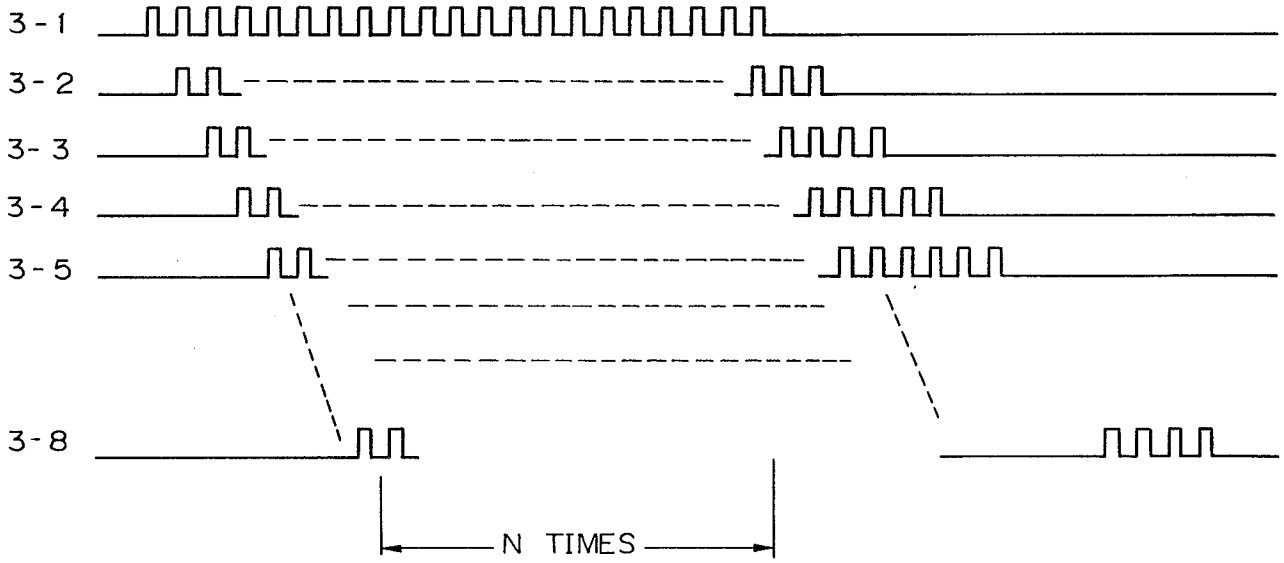
FIG. 4 is a timing chart showing the output signals of H-port in said preliminary energizing procedure.

FIG. 2 is a block diagram of the electric circuit of an electronic calculator with printer utilizing the cartridge shown in FIG. 1A, wherein shown are a microprocessor unit (MPU) 6, with a driving port H-port, for data process and controlling a keyboard 8, an indicator 7 and a printer 15; driving IC's 9, 10 for driving heat-generating members 16 of the printer 15; a driving IC 11 for driving motor 12 of the printer 15; and a voltage supply unit 13 for power supply to various units. Flow charts shown in FIGS. 3A and 3D show the sequence of preliminary energizing to be executed after the start of power supply in the electronic calculator shown in FIG. 2, and flow charts shown in FIGS. 3B, 3C and 3D show the sequence of preliminary energizing to be executed after the absence of printing operation for a predetermined period. The flow chart shown in FIG. 3A consists of a step S1 for initializing a flag set register etc.; a step S2 of preliminary energizing shown in FIG. 3D; and a step S3 of usual process indicating calculation, key input and printer process. The flow chart shown in FIG. 3B is a timer interruption sequence for key reading, consisting of a step S4 for key reading, a step S5 for increasing the content of a counter C for measuring predetermined period of absence of printing operation, a step S6 for discriminating whether the count of said counter reaches the predetermined period T of absence of printing operation, a step S7 for setting a preliminary energizing flag YOBI when said period is reached, and a step S32 for terminating the interruption sequence. The flow chart shown in FIG. 3C shows a printing subroutine consisting of a step S8 for discriminating whether the flag YOBI is set; a step S9 for executing the preliminary energizing sequence shown in FIG. 3D when said flag is set; a step S10 for clearing the counter C and the flag YOBI; a step S11 for effecting a usual printing process in the printer 15; and a step S33 for terminating the sub-routine. The flow chart of preliminary energizing shown in FIG. 3D consists of steps S12, S13 for clearing a counter D and a data buffer B; a step S14 for stepping up the counter D; a step S15 for setting a carry signal; a step S16 for shifting the content of the data buffer B in combination with the carry signal to prepare data for liquid emission; a step S17 for releasing thus prepared data; a step S18 for turning off the output; a step S19 for discriminating whether the data has changed from (00000000) to (00000001), then (00000011) and finally to (11111111); a step S20 for clearing the counter D; steps S21 to S24 constituting a loop for releasing data (11111111) N times; a step S25 for clearing the counter D; steps S26 to S34 for emitting the same data twice until the data change from (11111111) to (00000000) in the inverse manner to the steps S14 to S19; and a step S36 for terminating the subroutine. A step S31 for dummy process regulates the interval of emission. FIG. 4 is a timing chart showing the output of the interface H-port when the preliminary energizing is executed according to the flow chart shown in FIG. 3D.

By actually driving the head according to the above-explained flow, it has been confirmed that the driving method of the present invention is not only sufficiently effective for resolving and preventing the nozzle clogging and defective ink emission but also effective for reducing the ink consumption.

SECOND EMBODIMENT

Figure 5:
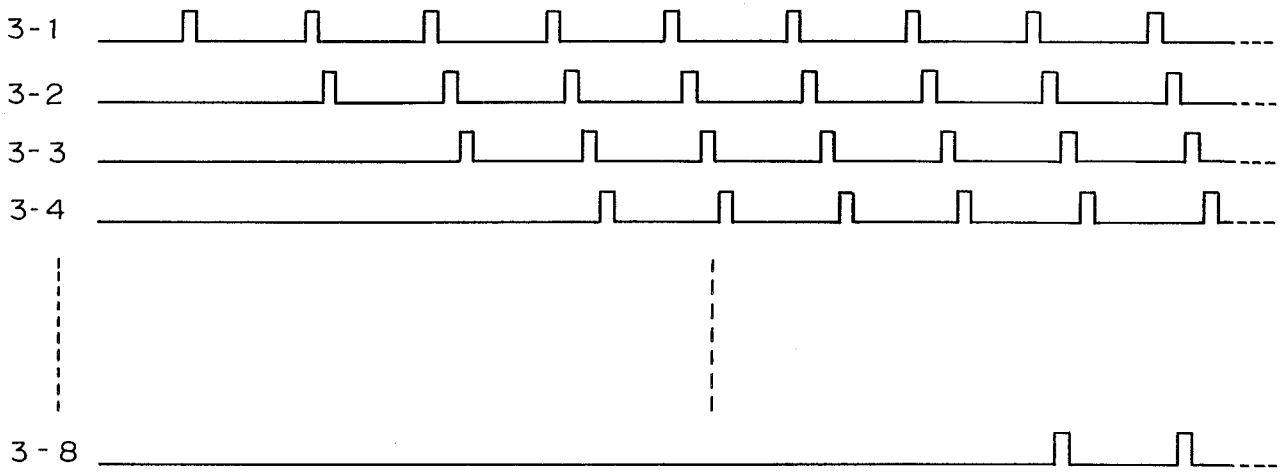
FIG. 5 is a timing chart of the H-port of the preliminary energizing procedure in another embodiment.

In the foregoing embodiment, the driving elements corresponding to the nozzles 3-1 to 3-8 are energized simultaneously, but it has also been confirmed that the above-mentioned objects can be achieved and the nozzle clogging and defective ink emission can be satisfactorily prevented or resolved, by energizing the driving elements at different timings as shown in FIG. 5, for the purpose of reducing the peak current of the voltage supply device thereby enabling the use of parts of lower grade and of protecting the head.

As explained in the foregoing, the present invention effects the energization of driving elements provided corresponding to the vertically arranged nozzles in succession starting from the one corresponding to the uppermost nozzle, with gradually increased amount of energization toward the driving element corresponding to the lowermost nozzle, and terminates the energization in succession from the driving element corresponding to the uppermost nozzle, thereby preventing or resolving the nozzle clogging without addition of hardware or increase in the manufacturing cost and without unnecessary ink emission, further suppressing the generation of bubbles from the dissolved gas particularly in the lower nozzles and enabling emission of ink of higher viscosity generally present more in the lower part of the nozzle.

Though the foregoing description has bee limited to a recording head with a disposable ink cartridge, the present invention is naturally applicable to ink jet recording heads of other types.

What is claimed is:

1. A driving method for driving an ink jet recording head to eject non-recording liquid for resolving or preventing clogging of, or defective liquid emission from, discharging nozzles, the method comprising the steps of:

providing an ink jet recording head having a plurality of discharging nozzles arranged in a vertical array and a plurality of heat generating members for ejecting liquid from corresponding said nozzles upon energization of said heat generating members by energizing circuitry, said recording head being mounted to a recording apparatus with said nozzles arranged in an array having a top portion and a bottom portion to emit liquid for recording;

determining if a pre-energization process should be initiated to eject non-recording liquid; and initiating, if so determined, the pre-energization process by energizing said heat generating members in a sequence to eject non-recording liquid from said nozzles, wherein a heat generating member corresponding to one discharge nozzle in the array is initially energized before a heat generating member corresponding to another discharge nozzle disposed in the array beneath said one discharge nozzle is initially energized.

2. A driving method according to claim 1, wherein the number of non-recording liquid ejections from nozzles near the bottom portion of the array is larger than the number of such ejections from nozzles at the top portion of the array.

3. A driving method according to claim 2, wherein the number of such ejections from any particular said nozzle is larger than the number of such ejections from the nozzle disposed in said array above said particular nozzle.

4. A driving method according to claim 1, wherein said plural nozzles communicate with a common liquid chamber.

5. A driving method according to claim 1, wherein all of said heat generating members are energized a plurality of times.

6. A driving method according to claim 1, wherein after the initial such ejection from any particular said nozzle, successive such ejections from said particular nozzle are provided substantially simultaneously with such ejections from nozzles disposed in said array above said particular nozzle.

7. A driving method according to claim 6, wherein a plurality of such ejections are provided from all of said nozzles and the plurality for any particular said nozzle is larger by a given number than the plurality for the nozzle disposed in said array immediately above said particular nozzle.

8. A driving method according to claim 1, wherein said given number is one.

9. A driving method according to claim 1, wherein said recording head has eight said nozzles.

10. A driving method according to claim 1, wherein the initial and any successive such ejection from any particular said nozzle is provided following such an ejection from the nozzle disposed in said array immediately above said particular nozzle.

11. A driving method according to claim 10, wherein said recording head has eight said nozzles.

12. A driving method for driving an ink jet recording head to eject non-recording liquid for resolving or preventing clogging of, or defective liquid emission from, discharging nozzles, the method comprising the steps of:

providing an ink jet recording head having first, second, third and fourth discharging nozzles arranged from top to bottom, respectively, in a vertical array, and first, second, third and fourth heat generating members corresponding to said first, second, third and fourth nozzles, respectively, for ejecting liquid from said nozzles upon energization of said heat generating members by energizing circuitry, said recording head being mounted to a recording apparatus with said nozzles arranged in an array having a top portion and a bottom portion to emit liquid for recording;

determining if a pre-energization process should be initiated to eject non-recording liquid; and initiating, if so determined, the pre-energization process by energizing said first heat generating member to discharge ink through said first discharge nozzle, and initially energizing said second heat generating member in correspondence with a subsequent energization of said first heat generating member to discharge ink through said second discharge nozzle, and initially energizing said third heat generating member in correspondence with a subsequent energization of said second heat generating member to discharge ink through said third discharge nozzle, and initially energizing said fourth heat generating member in correspondence with a subsequent energization of said third heat generating member to discharge ink through said fourth discharge nozzle.

13. A driving method according to claim 12, wherein the number of non-recording liquid ejections from said second nozzle is greater than the number of non-recording liquid ejections from said first nozzle, and the number of non-recording liquid ejections from said third nozzle is greater than the number of non-recording liquid ejections from said second nozzle, and the number of non-recording liquid ejections from said fourth nozzle is greater than the number of non-recording liquid ejections from said third nozzle.

14. A driving method according to claim 12, wherein each of said second, third and fourth heat generating members are energized substantially simultaneously with a subsequent energization of a heat generating member disposed directly above each said heat generating member in the array.

15. A driving method according to claim 12, wherein each of said second, third and fourth heat generating members are energized substantially successively with a subsequent energization of a heat generating member disposed directly above each said heat generating member in the array.

* * * * *

UNITED STATES PATENT AND TRADEMARK OFFICE

CERTIFICATE OF CORRECTION

PATENT NO. :4,965,608

DATED :October 23, 1990

INVENTOR(S) :Hayato Shinohara et al.

It is certified that error appears in the above-identified patent and that said Letters Patent is hereby corrected as shown below:

COLUMN 1:

Line 29, "ink emissions" should read --blank ink emissions--.

COLUMN 5:

Line 31, "claim 1," should read --claim 7,--; and

Line 33, "claim 1," should read --claim 7,--.

Signed and Sealed this

Fifth Day of May, 1992

*Attest:*

DOUGLAS B. COMER

*Attesting Officer*

*Acting Commissioner of Patents and Trademarks*